United States Patent [19]

Hutton

[11] Patent Number: 4,930,185

[45] Date of Patent: Jun. 5, 1990

[54] WINDOW STAY CAP MEMBER

[75] Inventor: Melvin Hutton, Braintree, England

[73] Assignee: Cego Limited, Essex, England

[21] Appl. No.: 290,238

[22] Filed: Dec. 22, 1988

[30] Foreign Application Priority Data

Dec. 24, 1987 [GB] United Kingdom ..... 8730176

[51] Int. Cl.[5] ..... E05D 11/10

[52] U.S. Cl. ..... 16/325; 16/333; 16/341; 16/360; 16/363; 16/370; 292/263; 49/248; 49/250; 49/251

[58] Field of Search ..... 16/321, 325, 333, 341, 16/342, 360, 361, 363, 364, 370, 371; 49/248, 250, 251, 252, 253, 256; 292/263, 267, 270, 274, 275, 278, 338

[56] References Cited

U.S. PATENT DOCUMENTS

| | | | |
|---|---|---|---|
| 1,750,664 | 3/1930 | Dreusike | 49/251 |
| 2,784,459 | 3/1957 | Anderberg et al. | 16/370 |
| 3,797,169 | 3/1974 | Armstrong | 16/361 |
| 4,102,012 | 7/1978 | Davis | 49/248 |
| 4,226,002 | 10/1980 | Davis | 49/248 |
| 4,674,149 | 6/1987 | Vetter | 16/370 |
| 4,689,852 | 9/1987 | Buckley | 16/363 |

FOREIGN PATENT DOCUMENTS

| | | | |
|---|---|---|---|
| 710005 | 6/1954 | United Kingdom | 16/364 |
| 2176533 | 12/1986 | United Kingdom | 16/341 |
| 2182386 | 5/1987 | United Kingdom | 292/263 |
| 2182387 | 5/1987 | United Kingdom | 292/263 |
| 2201997 | 9/1988 | United Kingdom | 292/263 |
| 2202271 | 9/1988 | United Kingdom | 292/263 |

*Primary Examiner*—Nicholas P. Godici

*Attorney, Agent, or Firm*—Leydig, Voit & Mayer

[57] ABSTRACT

A cap member for a window stay, particularly a four bar friction linkage stay, comprises a recess for receiving the tapered end of the bar which is attached to the openable vent of the window when the window is closed, and a pivotally mounted pawl member having a surface which defines an internal cam surface of the recess and which is adapted to engage and guide the tip of the bar as the window is closed and the tapered end enters the recess, the pawl pivoting so that when the tapered end is fully received in the recess the engagement between the tip of the bar and the inner edge of the pawl causes the outer edge of the pawl to bear against the inclined edge of the tapered end to hold the bar, and hence the window vent, firmly in the closed position.

9 Claims, 2 Drawing Sheets

WINDOW STAY CAP MEMBER

BACKGROUND OF THE INVENTION

1. Field of the invention

The present invention relates to window stays and, more particularly, to friction window stays of the four bar linkage type.

2. Summary of the prior art

A four bar friction linkage window stay is described in U.S. Pat. No. 2,784,459 (Anderberg). This type of stay comprises a slider which is moveable along an elongate track which is fixed to the window frame. Two links each have one end pivotally mounted to the slider. The other end of one link is pivotally connected to a bar which is fixed to the frame of the openable window vent. A strut is pivotally mounted to the track and is also pivotally connected to the other end of the other link and to an intermediate point on the bar. In the closed position of the window the bar overlies the track with the links and strut inbetween the track and the bar. The end of the track is provided with a cap member into which the end of the bar seats in the closed position of the stay. Such window stays may be mounted to the window frame at each side of the window so that the window vent will pivot open about its top edge, or at the head and sill of the window so that the vent will pivot open about one of its side edges. The window vent is held in a desired open position by the friction between the slider and the track. The cap member provided at the end of the track typically comprises two relatively inclined, internal cam surfaces against the outer one of which an inclined edge of the end of the bar can close with a wedging action in order to bring the vent into its properly closed position. Ideally the end of the bar should be held relatively tightly in the cap member in the closed position of the vent so as to prevent forcing of the window or rattling in adverse weather conditions. However, it must still be possible to open the window in the normal way without excessive resistance being provided by the cap member. An example of a cap member using two such internal cam surfaces is described in No. GB-A-2 133 074.

SUMMARY OF THE INVENTION

It is an objection of the present invention therefore to provide a cap member which holds the end of the bar firmly against transverse motion when the window is closed while allowing for easy closing and opening of the window.

The present invention accordingly provides a cap member for a window stay including a bar which is adapted to be secured to a frame member of an openable window vent, one end of the bar being arranged to be received in the cap member when the window vent is closed and being tapered to a tip so that it has at least one edge inclined relative to the longitudinal axis of the bar, said cap member comprising means defining a recess to receive said tapered end, and a pivotably mounted pawl having a surface defining an internal cam surface of the recess which is adapted to engage with the tip of the bar when the tapered end enters the recess upon closure of the window vent, the surface of the pawl extending from an inner edge at one side of its pivoting axis to an outer edge at the other side of said axis, whereby engagement between said inner edge and the tip of the bar when the tapered end is received in the recess causes said outer edge to bear against the inclined edge of the tapered end of the bar.

Since the pawl can pivot during the closing motion of the window stay, it is possible for the shape of the recess of the cap member to change as the stay closes. Initially a relatively wide angle is defined between the surface of the pawl and the remaining surface of the recess. However, interaction between the tip of the tapered end and the surface of the pawl as the stay is brought into its closed position, pivots the outer edge of the pawl inwardly so that it bears against the tapered edge in the closed position making a tight seal. The engagement between the tip and the inner end of the pawl prevents the pawl pivoting under a transverse force while the stay is closed. However, the stay can be quite readily opened again by the normal pivoting motion of the window vent, which moves the tapered end of the bar longitudinally as well as outwardly, freeing the inner edge of the pawl first so that the pawl can pivot in a sense to release the engagement between the outer edge and the inclined edge.

Such a cap member can be used on a four-bar friction linkage stay in which the bar overlies the track in the closed position of the stay as in the preferred embodiment described below in detail, or in conjunction with a stay where the bar lies offset from the track channel in the closed position of the stay as described in No. GB-A-2 182 387 and our co-pending G.B. application No. 87.30177.

Further characteristics and advantages of the invention will become apparent from the following description of one embodiment of the invention with reference to the accompanying diagrammatic drawings.

DESCRIPTION OF THE PREFERRED EMBODIMENT

Figure 1:
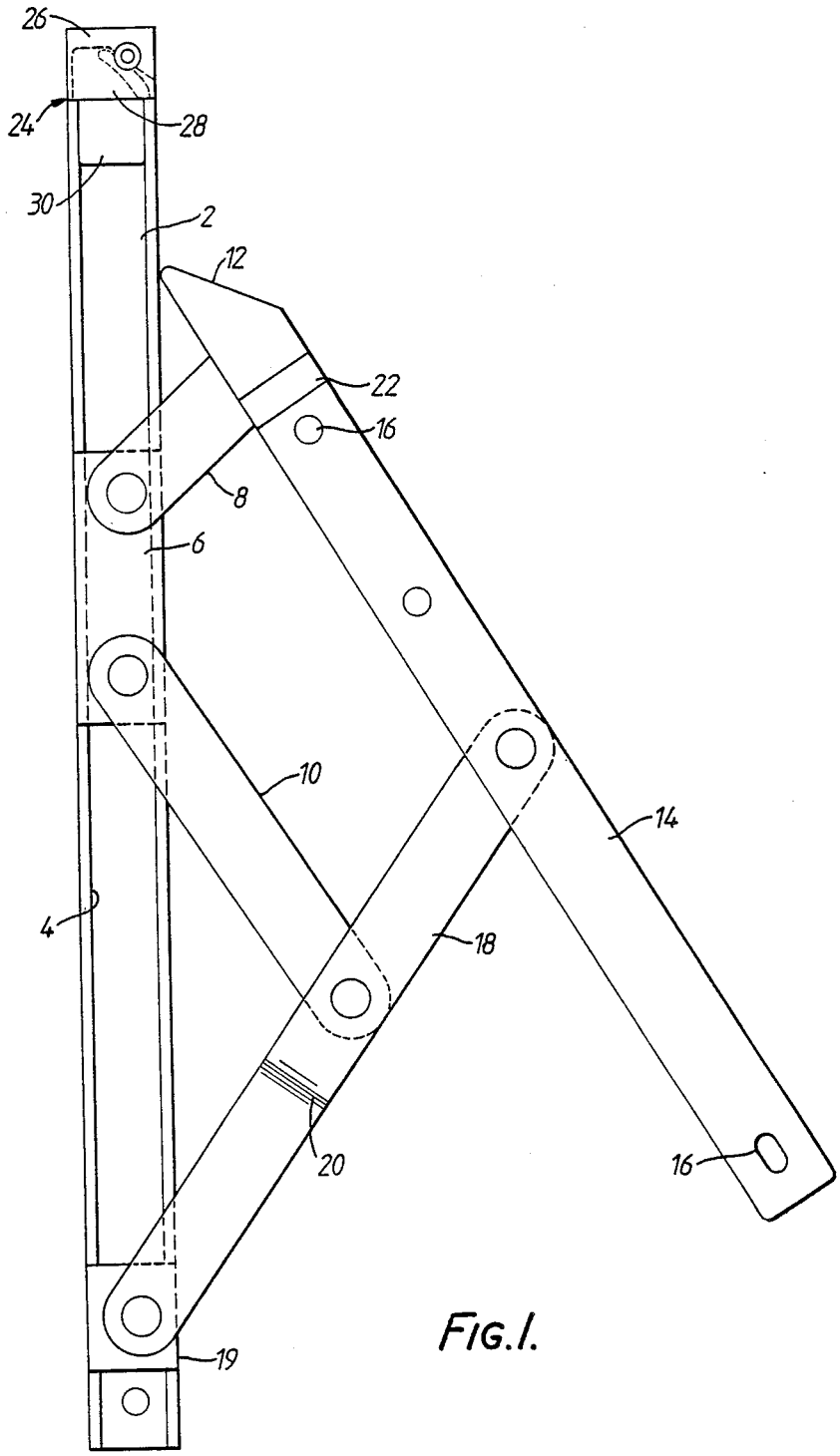
FIG. 1 is a plan view of a four bar friction linkage window stay in a partially opened position and incorporating a cap member in accordance with the invention.

The window stay illustrated in FIG. 1 is one of a pair. The other window stay of the pair is a mirror image of the stay illustrated, otherwise it is identical in all respects. Therefore, only one stay of the pair will be described.

The stay comprises a track 2 which defines an upwardly open channel 4 in which a lower guide portion of a slider 6 can be moved longitudinally of the track. First and second links 8, 10 each have one end pivotally connected to the slider 6. The other end of the first link 8 is pivotally connected close to one tapered end 12 of a bar 14 which is provided with fixing points 16 for securing it to the base of a recess in a head, sill or jamb of an openable window vent. The bar 14 is also pivotally connected at an intermediate point to one end of a strut 18 which has its other end pivotally connected to the track 2 via a support pad 19. The second link 10 has its end remote from the slider 6 pivotally connected to an intermediate point on the strut 18.

The strut 18 and the bar 14 are stepped at portions 20 and 22 respectively so that when the slider is moved to one of its extreme positions, the bar 14 can be closed up so that it overlies the track 2 with its end 12 received and retained by a cap member 24 fitted at the end of the track 2. In the closed position of the stay the bar 14 overlies the strut 18 and the links 8 and 10 above the track 2.

The track is an elongate member made of metal, preferably aluminum. The channel 4 is defined by upwardly extending inturned edges of a base. The track 2 is fixed to the window frame by means of counter-sunk screws which pass through fitting holes (not shown) in the base of the track.

The basic construction of the stay as so far described is essentially conventional and it will be appreciated that various modifications to this basic construction can be made. The cap member 24 is made up of a plastics moulding 26 which defines a recess 28 into which the tapered end 12 of the bar 14 fits in the closed position of the stay. The plastics moulding 26 defines upper and lower faces joined by an upstanding wall. The lower face is joined to a projecting tongue 30 which fits into the channel 4 and may be secured therein by means of a screw (not shown) passing through the channel and the tongue. Alternatively the tongue can be retained solely by frictional engagement in the channel. The wall between the faces of the cap member include a cam surface 32 aligned with the longitudinal axis of the track. This cam surface 32 guides the tip of the tapered end 12 during opening of the stay. The wall also includes an enlarged bearing section 34 provided with an arcuate cut-out 36 sized to receive a bearing portion 38 of a pivotal pawl 40. The upper and lower faces of the cap member are provided with holes which support ends of a pin 42 which passes through a bore in the bearing portion 38 in order to pivotally mount the pawl 40. Alternatively the upper and lower faces may be provided with inwardly projecting lugs which co-operate with openings at either side of the bearing portion in order to provide the required pivotal mounting without the use of an additional pin part. It will be noted that the wall does not extend beyond the outer edge of the bearing portion 34 although the upper and lower faces may do so. This allows the pawl 40 to pivot so that its outer edge projects beyond the edge of the track if required. The interior wall 44 of the bearing portion at either side of the cut-out 36 limits the permitted pivoting motion of the pawl in both senses.

Figure 2:
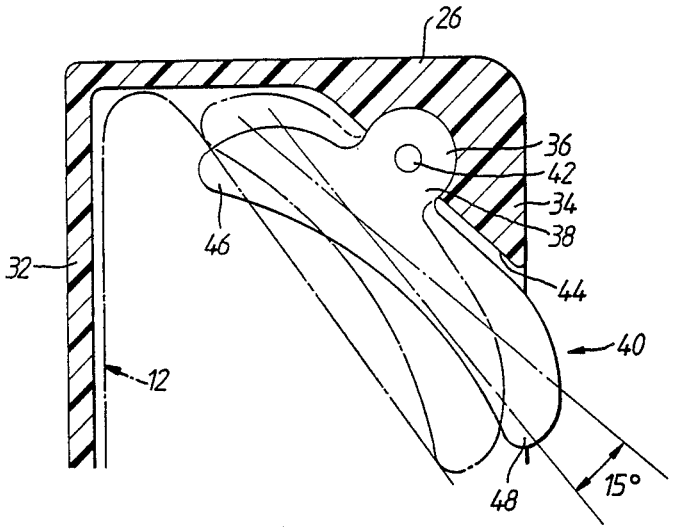
FIG. 2 is a transverse section through the cap member showing how the pawl pivots during opening and closing of the stay.

The pawl 40 is mounted so that it can pivot about the axis defined by the pin 42. It is provided with an inner edge 46 and an outer edge 48 at opposite sides of the pivoting axis. The inwardly facing surface between the edges 46 and 48 defines an internal cam surface of the recess 28. This surface is concave in order to facilitate entry and exit of the tapered end 12. During entry and exit of the tapered end the pawl pivots between the two limit positions shown in FIG. 2, which in this embodiment define a maximum pivot angle of about 15°. The pawl adopts the position shown in solid line when the stay is opened. If the pawl is not in this position as the stay is closed, it is knocked into this position by initial engagement of the tapered end with the outer edge 48 of the pawl. As the tapered end 12 of the bar moves into the recess, its tip is guided by the cam surface defined by the inner surface of the pawl. Once the tip has passed the normal to the surface from the pin 42, the pawl begins to pivot towards the position shown in dotted lines in FIG. 2. This final position is reached when the tapered end is fully seated in the recess 28. In this closed position the engagement between the inner edge 46 and the tip of the bar holds the pawl in its limit position causing the outer edge 48 to bear tightly against the inclined edge of the end of the bar. Once in this closed position the tapered end cannot move outwardly under transverse force that will be applied by anyone trying to force open the window. The cap member also provides an improved weather seal.

When the window is to be opened again the tip of the tapered end is guided by the other cam surface 32 of the recess. As the tip moves longitudinally, the inner edge of the pawl can pivot inwardly to widen the angle between the cam surfaces of the recess and allow the end 12 to move smoothly out of the cap member. Since the shape of the recess can change during opening and closing of the stay, it is possible to have a much tighter fit in the closed position than would be possible with fixed internal cam surfaces.

I claim:

1. A cap member for a window stay including a bar which is adapted to be secured to a frame member of an openable window vent, said bar having a longitudinal axis and one end which is arranged to be received in said cap member when said window vent is closed, and said one end having a tip and at least one edge inclined relative to the longitudinal axis of said bar whereby said one end is tapered to said tip thereof, said cap member comprising means defining a recess to receive said tapered end, and a pawl pivotably mounted to turn about a pivot axis, said pawl having a surface defining an internal cam surface of said recess which is adapted to engage said tip of said bar when said tapered end enters said recess upon closure of said window vent, and inner and outer edges disposed at opposite ends of said pawl surface such that said inner and outer edges lie on opposite sides of a plane which includes said pivot axis and is normal to said pawl surface, said pawl being arranged such that both said inner edge and said (tip) outer edge of said pawl engage and bear against said inclined edge of said tapered end of said bar when said window vent is in the closed position.

2. A cap member according to claim 1, wherein said pivot axis of said pawl is defined by a pivot pin, and said cap member includes upper and lower surfaces defining bearings in which said pivot pin is received.

3. A cap member according to claim 1, wherein said cam defining surface between said inner and outer edges of said pawl is concave.

4. A cap member according to claim 1, wherein said recess is further defined by means of a second cam surface arranged to be aligned parallel to the longitudinal axis of said bar when said window vent is closed and said tapered end of said bar is received in said recess.

5. A cap member according to claim 1, further comprising a projecting tongue adapted to be engaged in a track of said window stay in order to secure said cap member to said stay.

6. A cap member according to claim 1 in combination with a four-bar friction linkage window stay including a track which is adapted to be secured to the frame of a window and which receives a slider member of said stay, said cap member being secured to said track.

7. A cap member according to claim 6, wherein said recess of said cap member is aligned wth said track.

8. A cap member according to claim 6, wherein said recess of said cap member is laterally offset from said track.

9. A cap member according to claim 7, wherein said outer edge of said pawl projects beyond the edge of said track when said window vent is open.

* * * * *